US005205835A

United States Patent [19]

Tieckelmann et al.

[11] Patent Number: 5,205,835

[45] Date of Patent: Apr. 27, 1993

[54] PROCESS TO REMOVE MANGANESE DIOXIDE FROM WET PROCESS DENIM FIBERS BY NEUTRALIZING WITH PERACETIC ACID

[75] Inventors: Robert H. Tieckelmann, Trenton; Lisa M. Kurschner, Hamilton Square, both of N.J.

[73] Assignee: FMC Corporation, Philadelphia, Pa.

[21] Appl. No.: 651,811

[22] Filed: Feb. 7, 1991

[51] Int. Cl.[5] ..... D06L 3/02

[52] U.S. Cl. ..... 8/111; 8/101; 8/102

[58] Field of Search ..... 8/101, 102, 111; 252/186.28, 186.29, 186.41

[56] References Cited

U.S. PATENT DOCUMENTS

| | | | |
|---|---|---|---|
| 534,450 | 2/1895 | Clapham et al. . | |
| 1,361,833 | 12/1920 | Cushman . | |
| 1,925,564 | 9/1933 | Murray et al. . | |
| 3,384,444 | 5/1968 | Simpson et al. | 8/111 |
| 3,416,879 | 12/1968 | Sookne et al. | 8/115.5 |
| 4,218,220 | 8/1980 | Kappler et al. | 8/102 |
| 4,740,213 | 4/1988 | Ricci | 8/108 |
| 4,795,476 | 1/1989 | Bean et al. | 8/107 |
| 4,852,990 | 8/1989 | Patterson | 8/108.1 |
| 4,900,323 | 2/1990 | Dickson et al. | 8/111 |
| 4,919,842 | 4/1990 | Dickson et al. | 252/186.43 |
| 4,961,751 | 10/1990 | Eissele et al. | 8/111 |
| 5,006,124 | 4/1991 | Tieckelmann et al. | 8/111 |

*Primary Examiner*—Prince Willis, Jr.
*Assistant Examiner*—John F. McNally
*Attorney, Agent, or Firm*—R. E. Elden; P. C. Baker; R. L. Andersen

[57] ABSTRACT

A process is provided in which manganese dioxide stains in denim fabric which has been partially decolorized with potassium permanganate are neutralized or removed by an aqueous solution of peracetic acid containing at least 1 part by weight acetic acid and 1.5 parts by weight hydrogen peroxide per part by weight peracetic acid.

6 Claims, No Drawings

PROCESS TO REMOVE MANGANESE DIOXIDE FROM WET PROCESS DENIM FIBERS BY NEUTRALIZING WITH PERACETIC ACID

The technical field of this invention includes a process for removing dark colored manganese dioxide stains from faded denim fabric or made-up garments to provide a clean, yet faded appearance.

Denim garments such as jeans, jackets and skirts are considered by many to be more fashionable once they have attained a faded, worn appearance. Accordingly, denim fabrics and/or garments are frequently subjected to a bleaching procedure during their manufacture to give them a bleached, superbleached, rifled or white-washed appearance. While such prebleached goods are a very marketable product, the bleaching procedures conventionally employed are relatively labor intensive, which adds significantly to the cost of the bleaching process.

U.S. Pat. No. 4,218,220 discloses that it is sometimes desirable to prepare prefaded denim garments uniformly faded, that is prefaded blue jeans free of streaks. Satisfactory, unstreaked, suitably faded blue jeans were hitherto obtained only by repeated washings. The patent teaches subjecting the denim fabric to a washing cycle comprising an initial wash with detergent and emulsifier, a suitable intermediate rinsing operation, a bleaching operation in which the garments are subjected to the simultaneous action of bleach and a quaternary ammonium fabric softener optionally with the addition of a suitable amount of detergent, a further rinsing operation, and/or an optional final treatment with fabric softener and laundry sour. The patent teaches the use of a chlorine bleach typically sodium hypochlorite, trichloroisocyanuric acid or the like. U.S. Pat. No. 4,852,990 teaches a modification wherein denim garments are first desized, then contacted with an aqueous polyacrylic acid solution. A chlorine-type bleaching agent is subsequently added to provide a uniform bleached appearance.

Subsequently, the trend has been away from uniform fading and toward a look featuring random faded effects. One such manifestation of this trend is the practice of rocking or stone-washing, that is, tumbling the damp denims with pumice stones. The effect sought by this method is one of natural fading, a "used" look, characterized by a contrast between light and dark areas; in made-up garments however, the effect tends to appear on and around the seams only, whereas the color of the remaining fabric remains substantially uniform.

U.S. Pat. No. 4,740,213 discloses a process in which granules of a coarse, permeable material, such as pumice, are impregnated with a chlorine bleaching agent and are tumbled in a drum with denim fabric in a dry state. Traces of the chlorine bleaching agent are removed subsequently, optionally by an antichlor such as acidic hydrogen peroxide.

However, chlorine bleaching agents are known to be very destructive to cotton, consequently alternative bleaching agents have been employed to produce the faded look. Potassium permanganate is very desirable for such an oxidative treatment. When applied in a solution an even fading is obtained; when impregnated into an inert porous material by "rocking" a desired random uneven oxidation of colorbodies is obtained. Unfortunately, dark colored, insoluble manganese dioxide is deposited on the denim resulting in a dirty, stained appearance. The manganese dioxide can be removed by a process called "neutralizing", that is, reducing the manganese dioxide to soluble manganous salts with chemical reducing agents, usually sulfites, thiosulfate, hydroxylamine and the like as disclosed in U.S. Pat. Nos. 4,795,476; 534,450; 1,361,833 and 3,384,444. These reducing agents must be used in a large excess and at a pH of 2.5 to 3.0, causing damage to the cotton fibers. The excess reducing agent from the neutralizing step is very undesirable to dispose of because of its very high toxicity and high chemical oxygen demand of the effluents.

After neutralization the denim is frequently "brightened" or bleached to enhance the contrast between the dyed and the decolorized areas. A hypochlorite bleach or a sodium perborate bleach bath is usually employed for brightening.

Copending U.S. application Ser. No. 451,067 filed Dec. 15, 1989 now U.S. Pat. No. 5,006,124 claims a process for fading and bleaching denim fabric by contacting washed fabric with potassium permanganate and subsequently neutralizing the decolorized denim fabric between pH 3.0 and 6.0 in the presence of a carboxylic acid chelating agent and hydrogen peroxide. The decolorized denim fabric is subsequently bleached with an alkaline bleaching solution of hydrogen peroxide.

The process is very effective. However, some bleach plants are limited by their available equipment and would prefer not to require a separate acidic neutralizing step followed by an alkaline bleaching step. A further disadvantage is the cost of the chelating agent, and ultimately its disposal.

The present invention overcomes the disadvantages of the prior art process for processing denim by the steps of desizing the denim fabric, washing the desized fabric, contacting the washed fabric with potassium permanganate to oxidize part of the color-bodies in the denim fabric to a form which is easily removed from the fabric surface thereby partially decolorizing the denim fabric, and neutralizing the decolorized denim fabric by removing residues of the potassium permanganate and of the oxidized color-bodies, wherein the oxidized denim fabric is neutralized by contacting the fabric with an aqueous solution containing about 1.5 to 30 parts by weight peracetic acid per hundred parts by weight denim fabric. The aqueous solution also contains sufficient acetic acid and hydrogen peroxide to provide a peracetic:acetic acid:hydrogen peroxide weight ratio of at least 1:1:1.5. That is, the aqueous solution also contains sufficient acetic acid and hydrogen peroxide to provide at least 1 part by weight acetic acid and at least about 1.5 parts by weight hydrogen peroxide per part by weight peracetic acid. Commercially available peracetic acid is an equilibrium mixture of peracetic acid, acetic acid, hydrogen peroxide and water. In the absence of a catalyst a week or more may be required for equilibrium to take place. For the purpose of this invention the composition of the solution will be reported as the weight or mole ratio peracetic acid:acetic acid:hydrogen peroxide.

Peracetic acid is known as a strong oxidizing agent which is capable of oxidizing manganous ions to permanganate. Surprisingly, commercial peracetic acid does not decolorize the colorbodies (chromophores) usually used to dye denim. Commercial 35% peracetic acid does not remove manganese dioxide stains from denim without added hydrogen peroxide to adjust the PAA:$H_2O_2$ ratio to 1:1.5.

Desirably, the aqueous solution will contain by weight either about 1 part by weight peracetic acid, 3 parts by weight of acetic acid and at least one part by weight hydrogen peroxide (a 1:3:1 weight ratio), or at least one part by weight peracetic acid, one part by weight acetic acid and about 1.5 parts by weight hydrogen peroxide (1:1:1.5). A weight ratio greater than 1:5:3 is effective but may not be economical. Preferably, the aqueous solution will contain a 1:3:1.5 weight ratio of peracetic acid:acetic acid:$H_2O_2$. The denim fabric may be treated as a single batch by immersion, as a series of batch immersions or continuously by spraying or counter-current immersion or treatment.

One skilled in the art will readily recognize that the total amount of aqueous solution required will depend on the amount of manganese dioxide on the fabric and the degree of color removal required.

The process is effective over a wide temperature range, for example, from 0° C. to 100° C. The time of contact decreases with an increase of temperature. The range of about 15° (room temperature) to 65° is generally desirable.

Optionally including 1% to 5% surfactant on the weight of the goods (owg) in the aqueous solution will increase its efficacy in removing manganese dioxide. Generally, any nonionic or anionic surfactant which is inert to oxidizing agents is satisfactory.

Typical surfactants include alkyl sulfates, alkoxy sulfates, alkylaryl sulfonates, glycerol esters, polyoxyethylene alkylphenol; alcohols, ethers and esters of polyoxyethylene, polyoxypropylene or polyethylene glycol; and the like, either alone or as blends.

The denim fabric may be treated in any convenient form such as uncut piece goods, as partially fabricated garments or as finished garments. Denim is conventionally woven with colored warp and white filling threads but the term also includes striped denim fabrics or denim fabrics woven with both warp and filling threads colored. Usually the denims are dyed with vat dyes such as indigo or sulfur dyes or the like. Denim fabrics may also be woven with mixtures of cotton and synthetic fibers.

The process is particularly useful for producing a denim with a random faded pattern by the process of desizing the denim fabric, washing the desized fabric, contacting the washed fabric with potassium permanganate to oxidize part of the dye chromophores or colorbodies in the denim fabric to a form which is easily removed from the fabric surface, thereby decolorizing the denim fabric, and neutralizing the decolorized denim fabric by removing residues of the potassium permanganate and of the oxidized colorbodies.

The denim fabric may be desized by contacting the denim fabric with an effective amount of a peroxygen compound and 0.2% to 3% surfactant owg (preferably 1% to 2%) at pH 7-12 (preferably 9-10) for a sufficient time (5-15 minutes, preferably 10-12 minutes), thereby substantially removing sizing therefrom. An effective amount of a peroxygen compound for desizing is desirably 0.5% to 3% sodium persulfate owg or 2% to 6% hydrogen peroxide owg (100% basis). This process has the advantage of counteracting BOD of the effluents compared to enzymatic design processes and of not discharging boron compounds to the environment as the sodium perborate desize processes do.

Either sodium persulfate or hydrogen peroxide are particularly desirable to remove both starch and polyvinyl alcohol, the two types of sizing generally used for weaving denims.

As used herein all percentages are by weight; "owg" stands for on weight of goods.

The procedures are employed in the examples to illustrate the embodiments of the invention and not to limit the scope thereof.

DECOLORIZATION PROCEDURE

The sample preparation or decolorization process was simulated by placing a 4 inch square desized sample (approximately 5 grams) in a 500 mL Erlenmeyer flask. 50 mL of 2% $KMnO_4$ solution was added to the flask and allowed to react 15 minutes at room temperature. The $KMnO_4$ solution was poured off and the denim sample rinsed with three 100 mL portions of deionized water.

In the neutralization process 100 mL of neutralization liquor was added to the flask (Table I). The flask was then agitated at room temperature for 10 minutes. The neutralization liquor was poured off and the sample rinsed with three 100 mL portions of deionized water. The degree of manganese removal ($MnO_2$) was evaluated on an arbitrary scale of 10 (no decrease in color) to 1 (no perceptible residual $MnO_2$ color).

For convenience a commercial 15% peracetic acid (15% PAA), an equilibrium mixture, was employed as the source of the peracetic acid and part of the acetic acid and hydrogen peroxide. As used herein "15% PAA" stands for the equilibrium solution while "PAA" alone stands for the peracetic acid therein. For example, 200% owg 15% PAA provides 30% owg PAA. Additional acetic acid (HOAc) and hydrogen peroxide ($H_2O_2$) are added to provide the desired PAA:HOAc:-$H_2O_2$ weight or mole ratio.

EXAMPLE 1

A series of seven runs were made in which the total amount of peracetic acid (PAA) was varied as presented in Table I.

The data indicate at least 10 parts by weight peracetic acid is required per 100 parts by weight goods (10% owg 15% PAA) to obtain a noticeable stain removal. The data also show that adding additional acetic acid to the equilibrium commercial 15% peracetic acid enhances stain removal.

In each of the formulations in Table I, the weight ratio of acetic acid to hydrogen peroxide is 1:5 or a 1:3.4 mole ratio.

EXAMPLE 2

A series of 3 runs, 2A, 2B and 2C were carried out in a similar manner to Example 1. Example 2 demonstrates it is desirable for the acetic acid to hydrogen peroxide molar ratio to be at least 1:1. As the molar ratio of acetic acid to hydrogen peroxide approached 1:1, the amount of $MnO_2$ removal increased.

EXAMPLE 3

Effect of Temperature

The procedure followed was the same as described in Example 1 with the exception that instead of agitating the sample by hand an oscillating bath was used. Because the oscillating bath did not provide as much mechanical action as manual agitation, a control sample was employed for the room temperature "control". The neutralization formulation used was 10% owg of peracetic acid (15% commercial peracetic), or 10% owg 15% PAA, with an additional 2.5% owg acetic acid. The temperatures were 50° C. and 65° C. as well as room temperature (about 18° C.).

The sample produced at 50° C. (Sample 3A) exhibited less $MnO_2$ discoloration than the control sample (produced at room temperature) and the sample produced at 65° C. (Sample 3B) exhibited less discoloration than Sample 3A. As the temperature increased the amount of $MnO_2$ discoloration decreased.

EXAMPLE 4

Effect of Surfactants

The procedure of Example 1 and the formulation of Example 3 were used at 65° C. to evaluate the effect of surfactants on the ability of the formulation to remove $MnO_2$ discoloration. Concentration of each surfactant in the formulation was 1% owg. In each case, samples produced with formulations containing surfactants exhibited less $MnO_2$ discoloration than the control sample produced without surfactant. All surfactants performed equally. The surfactants are listed by trademark, manufacture, location and generic type.

4A. Vircoscour New-LF; Virkler Chemicals, Charlotte N.C.;anionic detergent.

4B. DowFax ® 2Al; Dow Chemical, Midland Mich.; 47% dodecyl (sulfophenol) benzenesulfonic acid, disodium salt.

4C. Rapid Scour; Gist Brocades, Charlotte N.C.; proprietary formula.

4D. Silvatol PBS; Ciba Geigy, Greensboro N.C.; cryptoanionic ethylene oxide concentrate.

4E. Denwet; Denim Finishing Supplies Colo., Mobile AL; proprietary formula.

4F. Lakol Scour CP-16; Dexter Chemical Corp., Bronx N.Y.; phosphate ester/alkyl phenol ethoxylate, 8% hexylene glycol.

4G. Kieralon NB-OL Liquid; BASF Corp Chemicals Division, Parsippany N.J.; mixture of anionic/nonionic surfactants, proprietary formula.

EXAMPLE 5

Active Oxygen Content

An experiment was conducted to determine if the performance of the peracetic acid formulation was due to the active oxygen content (AO) or to unique properties of peracetic acid. The peracetic acid formulation was compared to an effective hydrogen peroxide formulation (Table III). The procedure followed was that described in Example Three at 65° C.. Formulation 5A was a peracetic acid formulation found to be effective in the laboratory. Formulation 5B was an hydrogen peroxide formulation used in a mill trial. Formulations 5C and 5D were modifications of Formulation 5B that increased the AO content to that of Formulation 5A. In Formulation 5C, the sample received two treatments whereas in 5D the sample received one treatment. The concentration of active ingredients added to each sample (5C and 5D) was the same. Formulation 5E was identical to 5A, except the sample was treated in two steps instead of one.

The overall effectiveness of each treatment was determined by the amount of $MnO_2$ discoloration that was removed. The results indicate that the greater the AO, more $MnO_2$ discoloration was removed. However, Formulations 5A, 5E, 5C and 5D had identical AO content yet 5A and 5E produced samples with the least $MnO_2$ discoloration (a rating of 3). Therefore, the peracetic acid present in these formulations was beneficial. The results also indicate that while the hydrogen peroxide formulations perform better in two steps, the peracetic acid formulations unexpectedly perform equally well in one or two steps. Eliminating one step in production has the advantage of increasing throughput.

EXAMPLE 6

Peracetic Acid to Hydrogen Peroxide Molar Ratio

This example demonstrates the importance of the molar (and therefore the weight) ratios of the components of the peracetic acid formulations. The procedure followed was that described in Example 3 at 65° C.

FMC peracetic acid solutions are produced in concentrations of 15% and 35%. These solutions are equilibrium mixtures of peracetic acid, acetic acid and hydrogen peroxide. The weigh ratios of each component in the 15% and 35% solutions differ and therefore the molar ratios of the components of each stock solution differ.

Formulations 6A through 6D were prepared so that the AO and acetic acid contents of the formulations were the same regardless of the stock solution used in preparation. Formulations 6A and 6B were the same with 6B delivered in two steps instead of one, this applies to Formulations 6C and 6D as well.

Formulations 6A and 6B produced samples that were almost entirely free of $MnO_2$ discoloration, while Formulations 6C and 6D had no effect. As Table IV indicates, the difference in these formulations lies in the ratio of hydrogen peroxide to peracetic acid. In Formulations 6C and 6D, the molar ratio of hydrogen peroxide to peracetic acid was less than one. Therefore for optimum efficacy the hydrogen peroxide to peracetic acid molar ratio should be at least 3 to 1.

Formulations 6E and 6F were reformulations of 6C modified to bring the hydrogen peroxide to peracetic acid molar ratio to 3 to 1. When the hydrogen peroxide to peracetic acid ratio was changed, the formulation prepared from the 35% stock solution produced samples comparable to those produced by Formulations 6A and 6B.

Formulation 6C was unusual in that stain began to clear up and then both the solution and the sample turned purple indicating the formation of the permanganate ion. The solution then cleared, but all of the manganese appeared to have been redeposited on the fabric. It is well known that peracetic acid is a powerful oxidant which will oxidize manganous ions to permanganate. It is also well known that peracetic acid is an equilibrium mixture in which peracetic acid and water are in equilibrium with acetic acid and $H_2O_2$.

TABLE I

| RUN | FORMULATION | WT RATIO OF COMPONENTS (PAA:HOAc:$H_2O_2$) | MOLAR RATIO OF COMPONENTS (PAA:HOAc:$H_2O_2$) | RATING[4] |
|---|---|---|---|---|
| 1A | 200% owg[1] 15% PAA[2] | 1:1:1.5 | 1:1.4:3.4 | 2 |
| 1B | 200% owg 15% PAA | 1:2:1.5 | 1:2.5:3.4 | 1 |

TABLE I-continued

| RUN | FORMULATION | WT RATIO OF COMPONENTS ($PAA:HOAc:H_2O_2$) | MOLAR RATIO OF COMPONENTS ($PAA:HOAc:H_2O_2$) | RATING[4] |
|---|---|---|---|---|
| | 30% owg HOAc[3] | | | |
| 1C | 200% owg 15% PAA<br>30% owg HOAc<br>2% owg chelating agent | 1:2:1.5 | 1:2.5:3.4 | 1 |
| 1D | 20% owg 15% PAA<br>3% owg HOAc | 1:2:1.5 | 1:2.5:3.4 | 3 |
| 1E | 20% owg 15% PAA<br>3% owg HOAc<br>(per each of 2 neutralization steps) | 1:2:1.5 | 1:2.5:3.4 | 3 |
| 1F | 40% owg 15% PAA<br>6% owg HOAc<br>(delivered in 1 neutralization step) | 1:2:1.5 | 1:2.5:3.4 | 3 |
| 1G | 10% owg 15% PAA<br>1.5% owg HOAc | 1:2:1.5 | 1:2.5:3.4 | 4 |

[1]owg = "on the weight of the goods"
[2]PAA = Peracetic Acid
[3]HOAc = Acetic Acid
[4]Samples rated visually. 1 = no brown discoloration 10 = sample completely brown (untreated)

TABLE II

| RUN | FORMULATION | WT RATIO OF COMPONENTS ($PAA:HOAc:H_2O_2$) | MOLAR RATIO OF COMPONENTS ($PAA:HOAc:H_2O_2$) | RATING[4] |
|---|---|---|---|---|
| 2A | 10% owg[1] 15% PAA[2]<br>1.5% owg HOAc[3] | 1:2:1.5 | 1:2.6:3.4 | 4 |
| 2B | 10% owg 15% PAA<br>2.5% owg HOAc | 1:2.7:1.5 | 1:3.5:3.4 | 3 |
| 2C | 10% owg 15% PAA | 1:1:1.5 | 1:1.4:3.4 | 5 |

[1]owg = "on the weight of the goods"
[2]PAA = Peracetic Acid
[3]HOAc = Acetic Acid
[4]Samples rated visually.
1 = no brown discoloration
10 = sample completely brown

TABLE III

| RUN | TREATMENT | MOLES A.O. FROM PAA | MOLES A.O. FROM H2O2 | TOTAL MOLES A.O. | MOLES HOAc | MOLAR RATIO PAA:HOAc: H2O | WEIGHT RATIO PAA:HOAc: H2O2 | RAT-ING |
|---|---|---|---|---|---|---|---|---|
| 5A | 10% owg 15% PAA<br>2.5% owg HOAc<br>(1 neutralization) | $9.87 \times 10^{-4}$ | $3.38 \times 10^{-3}$ | $4.37 \times 10^{-3}$ | $3.41 \times 10^{-3}$ | 1:3.5:3.4 | 1:2.7:1.5 | 3 |
| 5B | 1% owg $H_2O_2$ (100%)<br>2% owg HOAc<br>(per each of 2 neutralizations) | 0.0 | $2.94 \times 10^{-3}$ | $2.94 \times 10^{-3}$ | $3.33 \times 10^{-3}$ | 0:1:0.88 | 0:1:0.5 | 6 |
| 5C | 1.5% owg $H_2O_2$ (100%)<br>2.7% owg HOAc<br>(per each of 2 neutralizations) | 0.0 | $4.37 \times 10^{-3}$ | $4.37 \times 10^{-3}$ | $4.50 \times 10^{-3}$ | 0:1:1 | 0:1:0.56 | 4 |
| 5D | 3% owg $H_2O_2$ (100%)<br>5.4% owg HOAc<br>(1 neutralization) | 0.0 | $4.37 \times 10^{-3}$ | $4.37 \times 10^{-3}$ | $4.50 \times 10^{-3}$ | 0:1:1 | 0:1:0.56 | 5 |
| 5E | 5% owg 15% PAA<br>1.5% owg HOAc<br>(per each of 2 neutralizations) | $9.87 \times 10^{-4}$ | $3.38 \times 10^{-3}$ | $4.37 \times 10^{-3}$ | $3.41 \times 10^{-3}$ | 1:3.5:3.4 | 1:2.7:1.5 | 3 |

1. Samples rated visually. 1 = no brown discoloration 10 = sample completely brown

TABLE IV

| RUN | TREATMENT | MOLES A.O. FROM PAA | MOLES A.O. FROM H2O2 | TOTAL MOLES A.O. | MOLES HOAc | MOLAR RATIO PAA:HOAc: H2O | WEIGHT RATIO PAA;HOAc: H2O2 | RAT-ING |
|---|---|---|---|---|---|---|---|---|
| 6A | 10% owg 15% PAA<br>6% owg HOAc<br>(1 neutralization) | $9.87 \times 10^{-4}$ | $3.38 \times 10^{-3}$ | $4.37 \times 10^{-3}$ | $6.36 \times 10^{-3}$ | 1:6.4:3.4 | 1:5:1.5 | 2 |
| 6B | 5% owg 15% PAA<br>3% owg HOAc<br>(per each of 2 | $9.87 \times 10^{-4}$ | $3.38 \times 10^{-3}$ | $4.37 \times 10^{-3}$ | $6.36 \times 10^{-3}$ | 1:6.4:3.4 | 1:5:1.5 | 2 |

TABLE IV-continued

| RUN | TREATMENT | MOLES A.O. FROM PAA | MOLES A.O. FROM H2O2 | TOTAL MOLES A.O. | MOLES HOAc | MOLAR RATIO PAA:HOAc: H2O | WEIGHT RATIO PAA;HOAc: H2O2 | RATING |
|---|---|---|---|---|---|---|---|---|
| | neutralizations) | | | | | | | |
| 6C | 13% owg 35% PAA (1 neutralization) | $3.06 \times 10^{-3}$ | $1.31 \times 10^{-3}$ | $4.37 \times 10^{-3}$ | $4.29 \times 10^{-3}$ | 1:1.4:0.43 | 1:1:0.2 | 10* |
| 6D | 6.5% owg 35% PAA (per each of 2 neutralizations) | $3.06 \times 10^{-3}$ | $1.31 \times 10^{-3}$ | $4.37 \times 10^{-3}$ | $4.29 \times 10^{-3}$ | 1:1.4:0.43 | 1:1:0.2 | 9 |
| 6E | 13% owg 35% PAA 6% owg $H_2O_2$ (100%) (1 neutralization) | $3.06 \times 10^{-3}$ | $1.04 \times 10^{-2}$ | $1.35 \times 10^{-2}$ | $4.29 \times 10^{-3}$ | 1:1.4:3.4 | 1:1:1.5 | 2 |
| 6F | 13% owg 35% PAA 6% owg $H_2O_2$ (100%) 7% owg HOAc (1 neutralization) | $3.06 \times 10^{-3}$ | $1.04 \times 10^{-2}$ | $1.35 \times 10^{-2}$ | $1.04 \times 10^{-2}$ | 1:3.4:3.4 | 1:2.6:1.5 | 2 |

1. Samples rated visually. 1 = no brown discoloration 10 = sample completely brown
*Turns purple

We claim:

1. In a process for wet processing denim fabric by the steps of desizing the denim fabric, washing the desized fabric, contacting the washed fabric with potassium permanganate to oxidize part of the colorbodies in the denim fabric to a form which is easily removed from the fabric surface thereby partially decolorizing the denim fabric, and neutralizing the decolorized denim fabric by removing residues of the potassium permanganate and of the oxidized colorbodies, the improvement comprising neutralizing the oxidized denim fabric by contacting the fabric with an aqueous solution containing about 1.5 to 30 parts by weight peracetic acid per hundred parts by weight denim fabric, said aqueous solution also containing sufficient acetic acid and hydrogen peroxide to provide a peracetic acid:acetic acid:hydrogen peroxide weight ratio of at least 1:1:1.5.

2. The process of claim 1 wherein said weight ratio is within the range 1:1:1.5 and 1:5:3 (1:1 to 5:1.5 to 3).

3. The process of claim 1 wherein said weight ratio is about 1:3:1.5.

4. The process of claim 1 wherein the aqueous solution provides between 3% and 30% owg peracetic acid.

5. The process of claim 2 wherein the aqueous solution provides between 3% and 30% owg peracetic acid.

6. The process of claim 3 wherein the aqueous solution provides between 3% and 30% owg peracetic acid.

* * * * *